US007249428B1

(12) United States Patent
Burella

(10) Patent No.: US 7,249,428 B1
(45) Date of Patent: Jul. 31, 2007

(54) UNIVERSAL FOOTWEAR INCLUDING REMOVABLE CLEATS

(76) Inventor: Gary Burella, 892 Eglinton Avenue East #25, Toronto, Ontario (CA) M4G 2L2

( * ) Notice: Subject to any disclaimer, the term of this patent is extended or adjusted under 35 U.S.C. 154(b) by 423 days.

(21) Appl. No.: 10/899,725

(22) Filed: Jul. 27, 2004

(51) Int. Cl.
*A43B 5/00* (2006.01)
*A43B 15/00* (2006.01)

(52) U.S. Cl. ..... 36/134; 36/67 D; 36/59 A; 36/7.5

(58) Field of Classification Search ..... 36/134, 36/67 D, 59 A, 15, 7.3, 7.6
See application file for complete search history.

(56) References Cited

U.S. PATENT DOCUMENTS 1,066,305 A * 7/1913 Mitchell ..... 36/15
2,183,277 A * 12/1939 Heilhecker ..... 36/14
3,019,534 A * 2/1962 Kauffman et al. ..... 36/15
4,296,558 A * 10/1981 Antonious ..... 36/50.1
4,380,878 A * 4/1983 Skaja ..... 36/67 D
4,420,894 A * 12/1983 Glassman ..... 36/12
5,410,823 A 5/1995 Iyoob
5,638,615 A 6/1997 Korsen
5,692,319 A * 12/1997 Parker et al. ..... 36/50.1
5,836,090 A 11/1998 Smith
5,875,572 A * 3/1999 Redburn ..... 36/134
5,979,083 A * 11/1999 Robinson et al. ..... 36/127
D466,272 S 12/2002 Erickson et al.
6,510,625 B2 * 1/2003 Sato et al. ..... 36/36 R
D474,592 S 5/2003 Fogg
2003/0093926 A1 5/2003 Auger et al.

* cited by examiner

*Primary Examiner*—Ted Kavanaugh

(57) ABSTRACT

A universal footwear includes removable cleats employable during indoor and outdoor activities such as sports, for example. The footwear includes a sole having toe, arch and heel portions respectively. Such a toe portion is provided with a plurality of receptacles, the arch portion includes a gel pack, and the heel has a bottom surface provided with a plurality of receptacles spaced thereabout. The apparatus further includes a body secured to the sole and a plurality of traversing straps extending thereacross for assisting to maintain an operator's foot at a stable position. A plurality of cleats are provided and are removably engageable with said plurality of receptacles, as desired by a user. One pair of shoes can be used for more than one sport thereby allowing a user to attach cleats to the shoe for any sport or remove all cleats from the shoe for casual wear.

15 Claims, 3 Drawing Sheets

UNIVERSAL FOOTWEAR INCLUDING REMOVABLE CLEATS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to footwear and, more particularly, to footwear including removable cleats for universal use such as when playing golf or other sports, for example.

2. Prior Art

The desirability of cleats and spikes on shoes for superior traction has long been recognized, particularly in the athletic endeavors of runners, golfers, football players, soccer players, and the like. It is also highly desirable that individual spikes be readily removable and replaceable where the spike has become broken, deformed, or otherwise impaired and where other gripping elements are desired.

Spikes are generally formed with the spike portion attached to the center of one side of a circular flange. Attached to the other side of the flange is a cylindrical, exteriorly threaded post. Standard golf shoes have a sole with cylindrical, interiorly threaded recesses therein for receiving the threaded post of a golf spike. The spike assembly is attached to the sole by screwing the threaded post into the threaded recess of the sole. Standard spikes have a circular flange having several holes on opposite sides of the conical spike portion capable of receiving the ends of a wrench or other tool used to tighten or loosen the spike assembly within the recess in the sole, for the purposes of installation and removal.

Problems in the prior art include the loss of spikes which are screwed into place or constructed of elastic material; damage to the supporting sole where rotational stress is placed upon a non-rotatable spike; complicated and expensive spike retention members; time required to inter-change spikes; and lateral movement of the spike members within sockets of studs, also causing loss or damage. Furthermore, individuals usually have to carry two pairs of shoes with them because spiked shoes are not allowed indoors at most facilities. The design of most sports footwear also makes them inconvenient to wear outdoors when it is hot.

Accordingly, a need remains for footwear including removable cleats that would be cost effective, easy to use, versatile, and comfortable to wear. The present invention satisfies such a need by being versatile enough to be worn in casual settings, with the cleats removed, as well as in sports settings when the cleats are attached. The footwear design allows for comfortable outdoor wear in warmer climates as well. The footwear allows one pair of shoes to be used for more than one sport.

BRIEF SUMMARY OF THE INVENTION

In view of the foregoing background, it is therefore an object of the present invention to provide universal footwear including removable cleats for more than one sport. These and other objects, features, and advantages of the invention are provided by a footwear apparatus including removable cleats for use when playing golf or other sports.

The footwear includes a flexible sole including toe, arch and heel portions sized and shaped for conforming to a user's foot. Such a toe portion has a generally arcuate shaped bottom surface provided with a plurality of receptacles spaced thereabout. The arch portion is spaced medially of the toe and heel portions and is integral therewith. Such an arch portion includes a gel pack disposed therein for advantageously providing support for a user's arch. The arch portion preferably has a width less than the width of the toe and the heel portions respectively so that a user comfort is not compromised during extended usage.

Such a heel portion extends rearwardly and downwardly from the arch portion and has a thickness greater than the arch and toe portions respectively. The heel portion has a bottom surface provided with a plurality of receptacles spaced thereabout and further has a generally arcuate edge for effectively conforming to a shape of a user's heel.

The present invention further includes a body portion secured to the heel, arch and toe portions, and extends vertically therefrom along a length of the sole. Such a body portion defines a cavity for conveniently receiving and supporting the foot of a user. The present invention also includes a plurality of traversing straps, preferably disposed adjacent the toe portion. Such a plurality of straps have opposed end portions permanently attached to the sole and removably attachable to the body, respectively, and for advantageously maintaining a user's foot in a substantially stable position during operating conditions.

The apparatus further includes a plurality of cleats that are removably attachable to the plurality of receptacles respectively. Such a plurality of cleats are preferably formed from resilient material and are provided with a plurality of notches for conveniently assisting a user to adapt the plurality of cleats during removal and insertion procedures. The plurality of cleats preferably have a shape selected from the group including a generally triangular shape, a generally rectangular shape, a generally conical shape and a generally flat shape. Each of the plurality of cleats has upper portions positionable within the plurality of receptacles. Of course, other conventional shapes may be employed by the present invention, as well known to a person of ordinary skill in the art of footwear.

The plurality of cleats preferably include a plurality of opposed flange portions spaced upwardly therefrom and are selectively engageable with the plurality of lip portions (described hereinbelow) respectively wherein the plurality of flange portions become disposed on top of the plurality of lip portions during engaged conditions. Such lip portions preferably extend along a horizontal plane and are disposed within the plurality of receptacles so that plurality of lip portions become disposed medially of the body and the plurality of lip portions. The plurality of lip portions are integral with the sole and extend downwardly from the plurality of receptacles respectively. Such a plurality of lip portions effectively define a plurality of support surfaces for advantageously maintaining the plurality of cleats at a substantially stable position, respectively.

In operation, a user simply presses the cleats upwardly beyond a horizontal plane defined by the lip portions, during installation procedures. To remove the cleats, a user compresses the flange portion inwardly by maintaining a grip along the notches and contemporaneously pulls the cleats downwardly from the receptacles until the flange portions become dislodged from the lip portions respectively.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
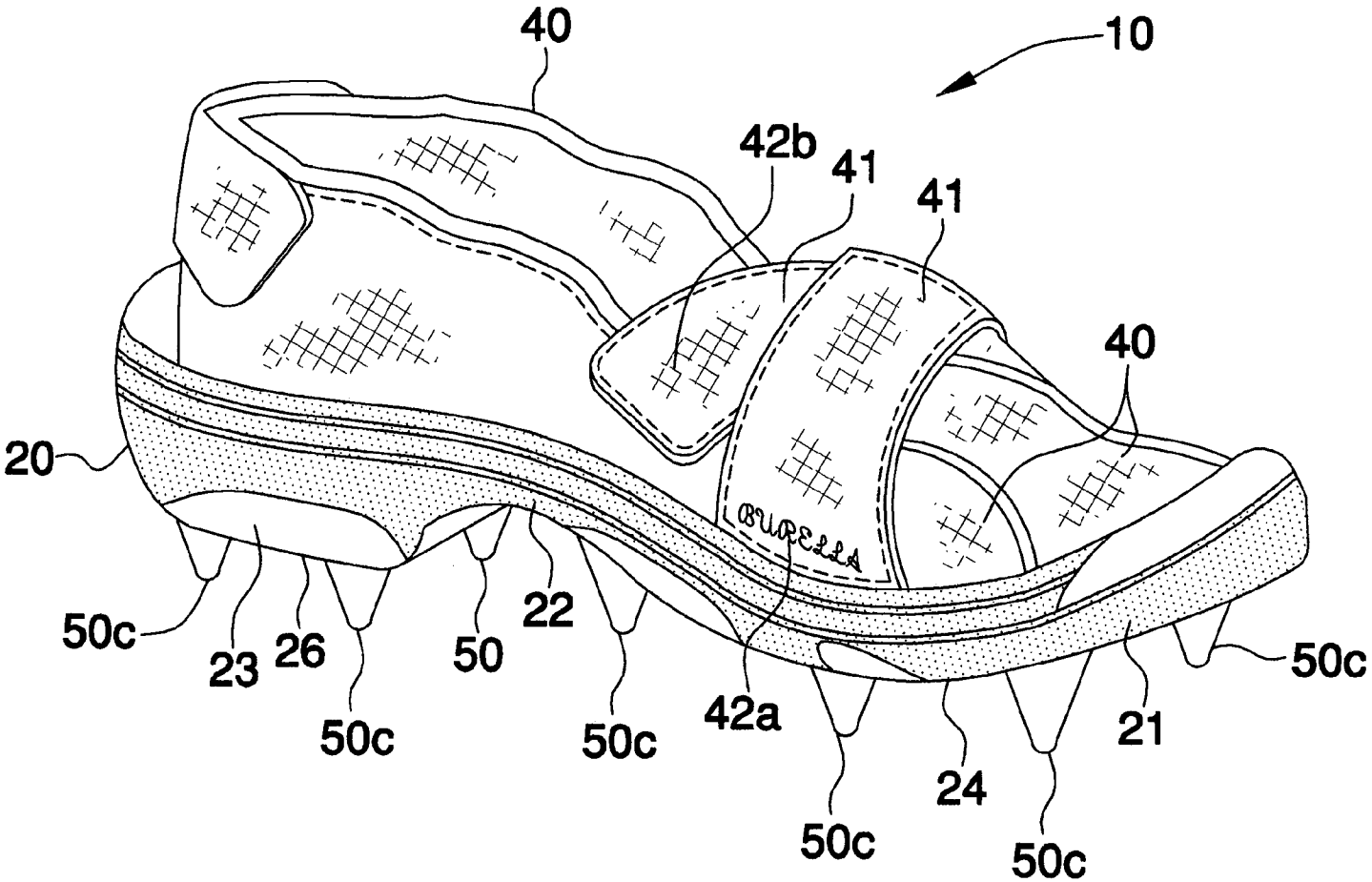
FIG. 1 is a perspective view showing footwear including removable cleats, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-4 by the reference numeral 10 and is intended to provide footwear including removable cleats. It should be understood that the footwear 10 may be employed in various indoor and outdoor environments and should not be limited to only golf.

Referring initially to FIG. 1, the apparatus 10 includes a flexible sole 20 including toe 21, arch 22 and heel 23 portions sized and shaped for conforming to a user's foot. Such a toe portion 21 has a generally arcuate shaped bottom surface 24 provided with a plurality of receptacles 25 spaced thereabout. The arch portion 22 is spaced medially of the toe 21 and heel 23 portions and is integral therewith.

Figure 2:
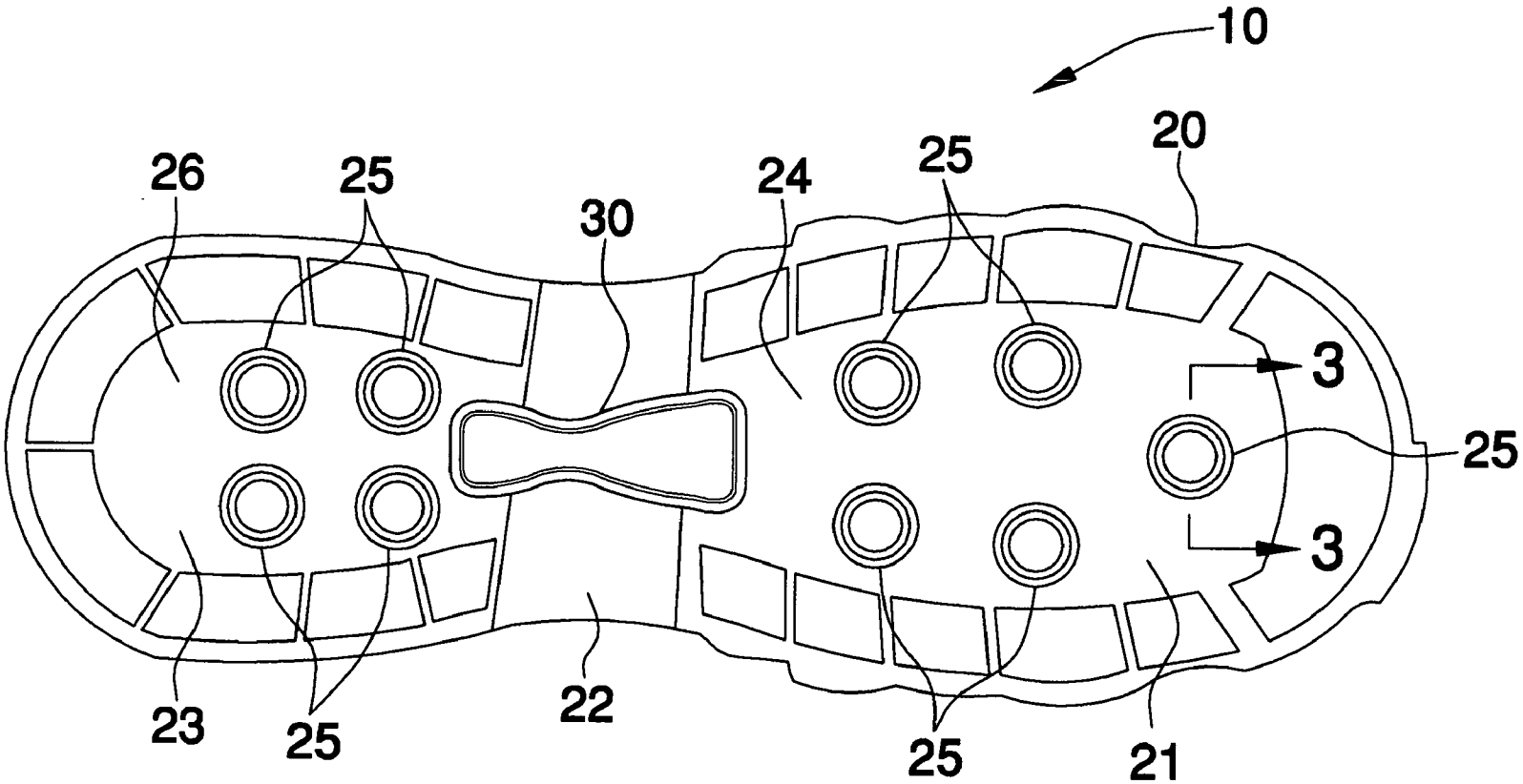
FIG. 2 is an enlarged bottom plan view of the apparatus shown in FIG. 1.

As is illustrated in FIG. 2, such an arch portion 22 includes a gel pack 30 disposed therein for advantageously providing support for a user's arch. This feature allows the footwear to be worn for longer periods of time while still providing adequate comfort to the user, which is advantageous in a situation such as golf that requires a lot of walking, and may take the whole day. The arch portion 22 has a width less than the width of the toe 21 and the heel 23 portions respectively so that a user's comfort is not compromised during extended usage.

Such a heel portion 23 extends rearwardly and downwardly from the arch portion 22 and has a thickness greater than the arch 22 and toe 21 portions respectively. The heel portion 23 has a bottom surface 26 provided with a plurality of receptacles 25 spaced thereabout and further has a generally arcuate edge for effectively conforming to a shape of a user's heel.

The present invention further includes a body portion 40 secured to the heel 23, arch 22 and toe 21 portions, and extends vertically therefrom along a length of the sole 20. Such a body portion 40 defines a cavity for conveniently receiving and supporting the foot of a user. The present invention also includes a plurality of traversing straps 41, disposed adjacent the toe portion 21. Such a plurality of straps 41 have opposed end portions 42*a*, 42*b* permanently attached to the sole 23 and removably attachable to the body 40, respectively, and for advantageously maintaining a user's foot in a substantially stable position during operating conditions. The body 40 and straps 41 have an open design that allows for continuous air circulation through the user's feet, keeping them cool and comfortable, which is advantageous during outdoor activities on hot summer days.

The apparatus 10 further includes a plurality of cleats 50 that are removably attachable to the plurality of receptacles 25 respectively. Such a plurality of cleats 50 are formed from resilient material and are provided with a plurality of notches 51 for conveniently assisting a user to adapt the plurality of cleats 50 during removal and insertion procedures. Conveniently, the cleats 50 may be quickly removed for casual wear, such as when entering facilities where shoes with cleats 50 are not allowed, thus allowing the wearer to abide by the club rules without having to purchase two separate pairs of shoes.

Figure 4:
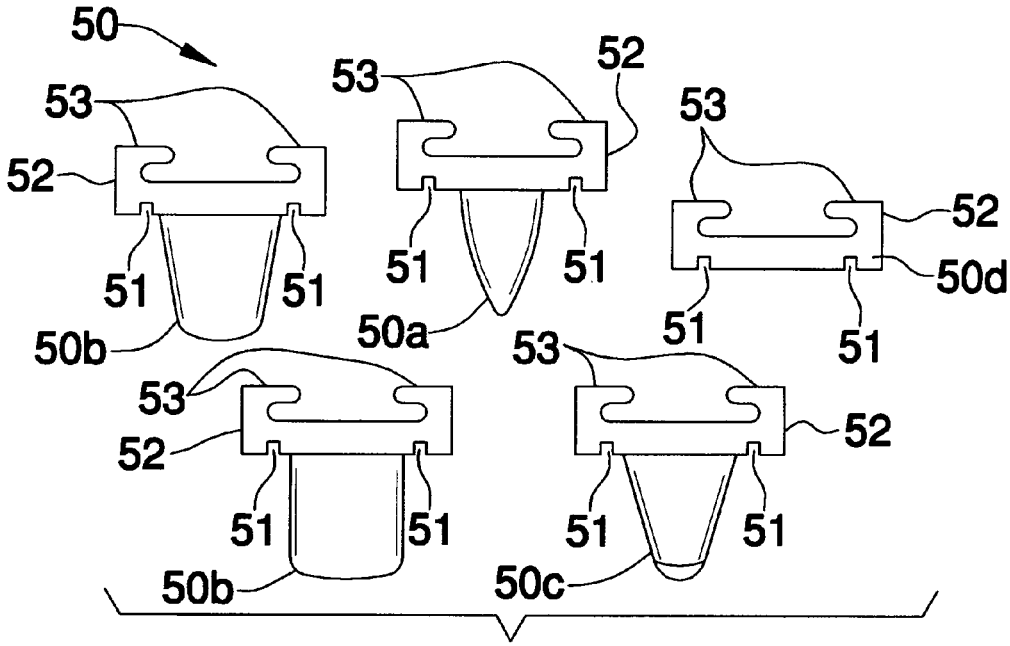
FIG. 4 is an enlarged side elevational view of the plurality of cleats.

As can be seen in FIG. 4, the plurality of cleats 50 have a shape selected from the group including a generally triangular shape 50*a*, a generally rectangular shape 50*b*, a generally conical shape 50*c* and a generally flat shape 50*d*. Each of the plurality of cleats 50 has upper portions 52 positionable within the plurality of receptacles 25. Of course, other conventional shapes may be employed by the present invention, as well known to a person of ordinary skill in the art of footwear. The various cleat 50 shapes a, b, c, d advantageously allow an individual to virtually "customize" their footwear 10 as the need of their particular sport may require. Furthermore, an individual now would only need one pair of footwear 10 as long as they have different sets of cleats 50 for the different sports they play.

Figure 3:
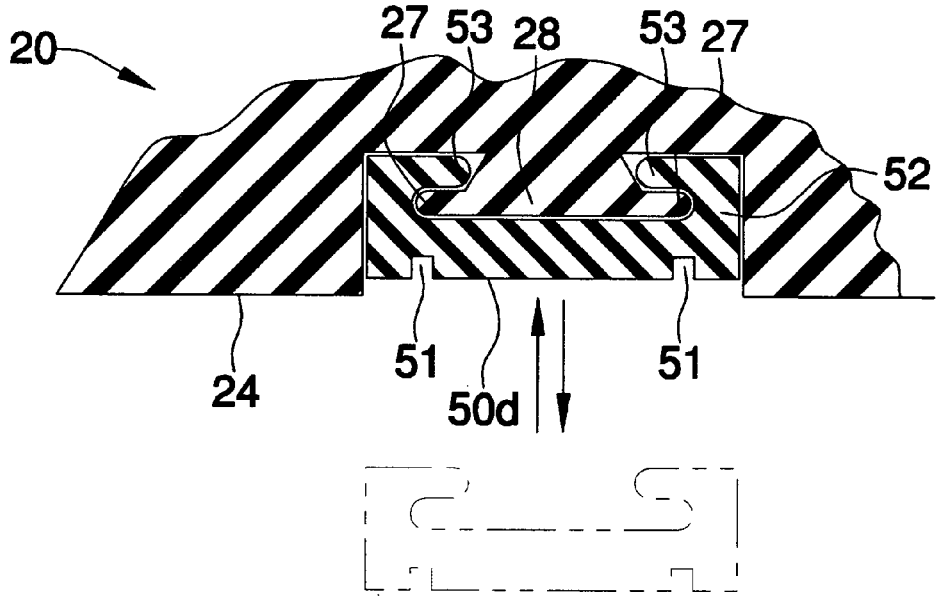
FIG. 3 is an enlarged cross-sectional view of the apparatus shown in FIG. 1, taken along line 3-3.

As is shown in FIG. 3, the plurality of cleats 50 include a plurality of opposed flange portions 53 spaced upwardly therefrom and are selectively engageable with the plurality of lip portions 27 (described hereinbelow) respectively wherein the plurality of flange portions 53 become disposed on top of the plurality of lip portions 27 during engaged conditions. Such lip portions 27 extend along a horizontal plane and are disposed within the plurality of receptacles 25 so that plurality of lip portions 27 become disposed medially of the body 40 and the plurality of lip portions 27. The plurality of lip portions 27 are integral with the sole 20 and extend downwardly from the plurality of receptacles 25 respectively. Such a plurality of lip portions 27 effectively define a plurality of support surfaces 28 for advantageously maintaining the plurality of cleats 50 at a substantially stable position, respectively.

In operation, a user simply presses the cleats 50 upwardly beyond a horizontal plane defined by the lip portions 27, during installation procedures. To remove the cleats 50, a user compresses the flange portion 53 inwardly by maintaining a grip along the notches 51 and contemporaneously pulls the cleats 50 downwardly from the receptacles 25 until the flange portions 53 become dislodged from the lip portions 27 respectively. Advantageously, this procedure can be performed by individuals of all ages, allowing the apparatus 10 to be used by sports enthusiasts of all ages.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A footwear apparatus including removable cleats for allowing the apparatus to be universally employable for more than one sport, said footwear comprising:

a flexible sole including toe, arch and heel portions sized and shaped for conforming to a user's foot, said toe portion having a generally arcuate shaped bottom surface provided with a plurality of receptacles spaced thereabout, said arch portion being spaced medially of said toe and heel portions and being integral therewith, said arch portion comprising a gel pack disposed therein and for providing support for a user's arch, said heel portion extending rearwardly and downwardly from said arch portion and having a thickness greater than said arch and toe portions respectively, said heel portion having a bottom surface provided with a plurality of receptacles spaced thereabout;

a body portion secured to said heel, arch and toe portions and extending vertically therefrom along a length of said sole, said body portion defining a cavity for receiving and supporting the foot of a user;

a plurality of traversing straps having opposed end portions permanently attached to said sole and removably attachable to said body for maintaining a user's foot in a substantially stable position during operating conditions respectively; and a plurality of cleats being removably attachable to said plurality of receptacles respectively, each said plurality of cleats having upper portions positionable within said plurality of receptacles.

2. The apparatus of claim 1, further comprising: a plurality of lip portions integral with said sole and extending downwardly from said plurality of receptacles respectively, said plurality of lip portions defining a plurality of support surfaces for maintaining said plurality of cleats at a substantially stable position respectively.

3. The apparatus of claim 2, wherein said plurality of cleats comprise: a plurality of opposed flange portions spaced upwardly therefrom and being selectively engageable with said plurality of lip portions respectively wherein said plurality of flange portions become disposed on top of said plurality of lip portions during engaged conditions.

4. The apparatus of claim 1, wherein said plurality of cleats have one shape selected from the group comprising: a generally triangular shape, a generally rectangular shape, a generally conical shape and a generally flat shape.

5. The apparatus of claim 1, wherein said plurality of cleats are formed from resilient material and are provided with a plurality of notches for assisting a user to adapt said plurality of cleats during removal and insertion procedures.

6. The apparatus of claim 1, wherein said plurality of straps are disposed adjacent said toe portion.

7. A footwear apparatus that can be used for more than one sport and including removable cleats, said footwear comprising:

a flexible sole including toe, arch and heel portions sized and shaped for conforming to a user's foot, said toe portion having a generally arcuate shaped bottom surface provided with a plurality of receptacles spaced thereabout, said arch portion being spaced medially of said toe and heel portions and being integral therewith, said arch portion comprising a gel pack disposed therein and for providing support for a user's arch, said arch portion having a width less than a width of said toe and said heel portions respectively, said heel portion extending rearwardly and downwardly from said arch portion and having a thickness greater than said arch and toe portions respectively, said heel portion having a bottom surface provided with a plurality of receptacles spaced thereabout;

a body portion secured to said heel, arch and toe portions and extending vertically therefrom along a length of said sole, said body portion defining a cavity for receiving and supporting the foot of a user;

a plurality of traversing straps having opposed end portions permanently attached to said sole and removably attachable to said body for maintaining a user's foot in a substantially stable position during operating conditions respectively; and a plurality of cleats being removably attachable to said plurality of receptacles respectively, each said plurality of cleats having upper portions positionable within said plurality of receptacles.

8. The apparatus of claim 7, further comprising: a plurality of lip portions integral with said sole and extending downwardly from said plurality of receptacles respectively, said plurality of lip portions defining a plurality of support surfaces for maintaining said plurality of cleats at a substantially stable position respectively.

9. The apparatus of claim 8, wherein said plurality of cleats comprise: a plurality of opposed flange portions spaced upwardly therefrom and being selectively engageable with said plurality of lip portions respectively wherein said plurality of flange portions become disposed on top of said plurality of lip portions during engaged conditions.

10. The apparatus of claim 7, wherein said plurality of cleats have one shape selected from the group comprising: a generally triangular shape, a generally rectangular shape, a generally conical shape and a generally flat shape.

11. The apparatus of claim 7, wherein said plurality of cleats are formed from resilient material and are provided with a plurality of notches for assisting a user to adapt said plurality of cleats during removal and insertion procedures.

12. The apparatus of claim 7, wherein said plurality of straps are disposed adjacent said toe portion.

13. A footwear apparatus including removable cleats for use when playing golf or other sports, said footwear comprising, a flexible sole including toe, arch and heel portions sized and shaped for conforming to a user's foot, said toe portion having a generally arcuate shaped bottom surface provided with a plurality of receptacles spaced thereabout, said arch portion being spaced medially of said toe and heel portions and being integral therewith, said arch portion comprising a gel pack disposed therein and for providing support for a users arch, said arch portion having a width less than the width of said toe and said heel portions respectively, said heel portion extending rearwardly and downwardly from said arch portion and having a thickness greater than said arch and toe portions respectively, said heel portion having a bottom surface provided with a plurality of receptacles spaced thereabout, said heel portion further having a generally arcuate edge for conforming to a shape of a user's heel;

a body portion secured to said heel, arch and toe portions and extending vertically therefrom along a length of said sole, said body portion defining a cavity for receiving and supporting the foot of a user;

a plurality of traversing straps having opposed end portions permanently attached to said sole and removably attachable to said body for maintaining a user's foot in a substantially stable position during operating conditions; and a plurality of cleats being removably attachable to said plurality of receptacles respectively, each said plurality of cleats having upper portions positionable within said plurality of receptacles;

a plurality of lip portions monolithically formed with said sole and extending downwardly from said plurality of receptacles respectively, said plurality of lip portions defining a plurality of support surfaces for maintaining said plurality of cleats at a substantially stable position respectively;

wherein said plurality of cleats comprise: a plurality of opposed flange portions spaced upwardly therefrom and being selectively engageable with said plurality of lip portions respectively wherein said plurality of flange portions become disposed on top of said plurality of lip portions during engaged conditions;

wherein said flange portions are monolithically and statically formed with said cleats and remain situated within said receptacle while engaged against said support surfaces respectively, each of said flange portions being located entirely above a bottom surface of said sole;

wherein said plurality of cleats are formed from resilient material and are provided with a plurality of notches for assisting a user to adapt said plurality of cleats during removal and insertion procedures;

wherein said notches are upwardly offset above said bottom surface of said sole and vertically aligned subjacent to outer of said flange portions respectively.

14. The apparatus of claim 13, wherein said plurality of cleats have one shape selected from the group comprising: a generally triangular shape, a generally rectangular shape, a generally conical shape and a generally flat shape.

15. The apparatus of claim 13, wherein said plurality of straps are disposed adjacent said toe portion.

* * * * *